US011673184B2

(12) United States Patent
Karhausen et al.

(10) Patent No.: US 11,673,184 B2
(45) Date of Patent: Jun. 13, 2023

(54) MELT FEEDING FOR STRIP CASTING SYSTEMS

(71) Applicants: Kai-Friedrich Karhausen, Bonn (DE); Ralph Bock, Bonn (DE); Manfred Langen, Bonn (DE); Wolfgang Müller, Bamberg (DE); Mark Badowski, Siegburg (DE)

(72) Inventors: Kai-Friedrich Karhausen, Bonn (DE); Ralph Bock, Bonn (DE); Manfred Langen, Bonn (DE); Wolfgang Müller, Bamberg (DE); Mark Badowski, Siegburg (DE)

(73) Assignee: Speira GmbH, Grevenbroich (DE)

( * ) Notice: Subject to any disclaimer, the term of this patent is extended or adjusted under 35 U.S.C. 154(b) by 0 days.

(21) Appl. No.: 17/563,768

(22) Filed: Dec. 28, 2021

(65) Prior Publication Data

US 2022/0118507 A1 Apr. 21, 2022

Related U.S. Application Data

(63) Continuation of application No. PCT/EP2020/068713, filed on Jul. 2, 2020.

(30) Foreign Application Priority Data

Jul. 3, 2019 (EP) ..... 19184161

(51) Int. Cl.
*B22D 11/10* (2006.01)
*B22D 11/06* (2006.01)
(Continued)

(52) U.S. Cl.
CPC ..... *B22D 11/10* (2013.01); *B22D 11/0622* (2013.01); *F27B 14/0806* (2013.01);
(Continued)

(58) Field of Classification Search
CPC . B22D 11/10; B22D 11/0622; F27B 14/0806; F27B 14/04; F27B 2014/008; F27B 2014/0818
See application file for complete search history.

(56) References Cited

U.S. PATENT DOCUMENTS 4,449,568 A 5/1984 Narasimham
2005/0253314 A1 11/2005 Choi et al.
(Continued)

FOREIGN PATENT DOCUMENTS

CN 1088861 A 7/1994
CN 1803334 A 7/2005
(Continued)

OTHER PUBLICATIONS

Zhicheng Han et al., "Double Roll Thin Strip Continuous Casting Side Seal", *Metallurgical Industry Press,* Jul. 31, 2008, pp. 245.
(Continued)

*Primary Examiner* — Scott R Kastler
(74) *Attorney, Agent, or Firm* — Reinhart Boerner Van Deuren P.C.

(57) ABSTRACT

A strip casting system for aluminium and/or aluminium alloys comprising a casting furnace and a revolving chill mould having a casting gap. The revolving chill mould is designed as a roll pair, roller pair, caterpillar pair or belt pair. The strip casting system has an active means for transporting metal melt from the casting furnace to the casting gap and a casting region arranged in front of the casting gap. The casting region is delimited on one side by the revolving chill mould. A melt pool is formed in the casting region, from which metal melt flows or is drawn into the casting gap. The casting furnace is connected to the casting region by a pipe system with means for feeding the metal melt into the casting region, which can feed the metal melt to the casting
(Continued)

region below the surface of the melt pool formed in the casting region.

13 Claims, 5 Drawing Sheets

(51) Int. Cl.
*F27B 14/08* (2006.01)
*F27B 14/04* (2006.01)
*F27B 14/00* (2006.01)

(52) U.S. Cl.
CPC ..... *F27B 14/04* (2013.01); *F27B 2014/008* (2013.01); *F27B 2014/0818* (2013.01)

(56) References Cited

U.S. PATENT DOCUMENTS

| | | | |
|---|---|---|---|
| 2011/0033332 A1 | 2/2011 | Numano et al. | |
| 2022/0118507 A1* | 4/2022 | Karhausen ..... | B22D 11/181 |

FOREIGN PATENT DOCUMENTS

| | | | |
|---|---|---|---|
| CN | 1684784 | A | 10/2005 |
| CN | 1871081 | A | 11/2006 |
| CN | 101269406 | A | 9/2008 |
| CN | 101961779 | A | 2/2011 |
| DE | 43 06 863 | C1 | 6/1994 |
| EP | 0 433 204 | A1 | 6/1991 |
| EP | 2467221 | A1 | 6/2012 |
| JP | S49-13775 | Y | 4/1974 |
| JP | S56-1251 | A | 1/1981 |
| JP | S57-26181 | B2 | 6/1982 |
| JP | S58 77746 | A | 5/1983 |
| JP | H04-1031 | U | 1/1992 |
| JP | H05-060645 | U | 8/1993 |
| JP | 2000-210760 | A | 8/2000 |
| JP | 2006-510491 | A | 3/2006 |
| JP | 2008 161875 | A | 7/2008 |
| JP | 2008161894 | A | 7/2008 |
| JP | 2016 147298 | A | 8/2016 |
| JP | 2016147298 | A | 8/2016 |
| JP | 2016-221567 | A | 12/2016 |
| WO | 2004-000487 | A1 | 12/2003 |
| WO | WO 2006/003899 | A1 | 1/2006 |
| WO | WO 2016/129344 | A1 | 8/2016 |

OTHER PUBLICATIONS

Jingan Liu et al., "The Key Technology of Aluminum Production", *Chongqing University Press,* May 31, 1997, pp. 1.

* cited by examiner

MELT FEEDING FOR STRIP CASTING SYSTEMS

CROSS-REFERENCE TO RELATED PATENT APPLICATIONS

This patent application is a continuation of International Application No. PCT/EP2020/068713, filed on Jul. 2, 2020, which claims the benefit of priority to European Patent Application No. 19184161.8, filed Jul. 3, 2019, the entire teachings and disclosures of both applications are incorporated herein by reference thereto.

FIELD OF THE INVENTION

The invention relates to a strip casting system comprising at least one casting furnace and at least one revolving chill mould with a casting gap, in particular a roll pair, roller pair, caterpillar pair or belt pair. The invention further relates to a method for feeding an aluminium or aluminium alloy melt to the casting gap in a strip casting system.

BACKGROUND OF THE INVENTION

Strip casting by means of strip casting systems is an economical and energy-efficient alternative to the conventional production of metal strips by means of ingot casting, reheating and hot rolling. In strip casting, a hot strip is produced close to the final dimensions directly from a metal melt. For this purpose, the metal melt is cast in a strip casting system in which the casting region or solidification region, in which the cast strip is formed, is delimited on at least one longitudinal side by a barrier which is continuously moved and cooled during the casting process. This barrier runs with the solidifying strip, so that a so-called revolving chill mould is provided. Revolving chill moulds allow a high casting and solidification speed. In industrial production, there are a number of configurations of such revolving chill moulds, for example casting wheel processes or single-roll processes. Due to the required widths of metal strips and further efficiency improvements, processes with two cooled revolving barriers arranged opposite one another, between which a casting gap is formed, have become established, in particular in the area of aluminium or steel strip casting. In particular, cast rolling by means of a two-roll process (twin roll casting) in a horizontal or tilted direction has become established, particularly in the aluminium industry; the vertical process is also used in the steel industry. In this case, the metal melt is introduced in particular into an internally cooled roller pair or roll pair and first solidifies in the casting gap between the two rollers or rolls, is then formed, pulled off as a strip and wound up, for example. On the other hand, the usually horizontally operated two-chain process (twin belt casting or Hazelett process) has become established in which the revolving chill mould is formed by opposite sides of two cooled (dam block) chains, between which a casting gap is formed, in which the metal melt solidifies. In addition, revolving chill moulds in the form of caterpillar chill moulds (block casting) are also used, in which cooling blocks consisting mostly of copper are arranged on chain segments. These are usually tilted slightly against the horizontal.

A problem with the known strip casting processes is that a variable solidification front can result over the width of the strip produced, which can result in uneven product properties. For example, surface defects, segregations of alloy elements or an uneven grain structure can result. Even metal melt that has not solidified locally can pass through the casting gap and thus lead to strip tearing and thus to process interruption. These problematic effects become more critical with larger strip widths, which are, however, particularly relevant for high process efficiency. The uniform supply of melt into the casting gap or the solidification zone of the revolving chill mould is therefore very important for all strip casting processes. Conventionally, the metal melt usually guided via an open channel system from a higher casting furnace is therefore calmed before the casting gap into an open tundish (intermediate vessel). Here, the metal melt is first collected in the tundish and then fed from the tundish to the casting gap by way of gravity. At the same time, the level of the melt pool in the casting region in front of the chill mould can be regulated via the tundish, for example by a stopper provided in the bottom of the tundish.

Such a strip casting system for carrying out a vertical two-roller process is known, for example, from WO 2004-000487. For a horizontal process with revolving chill mould, such a strip casting system with a tundish is described, for example, in EP 0 433 204 A1.

Strip casting systems for magnesium having a supply without tundish are known from JP 2016 147298 A and US 2011/033332 A1 in each case.

However, the disadvantage of these known methods is that on the one hand, the regulation of the feeding of the metal melt to the casting gap is difficult to control and is not very dynamic. On the other hand, in the event of a system failure, metal melt continues to flow by way of gravity in the direction of the casting gap, such that safety problems can arise. The metal melt also tends to oxidise. In particular, an aluminium melt oxidises very quickly on contact with oxygen on the surface, especially at high, process-related temperatures, and forms a relatively stable oxide layer. In the conventional process, the metal melt can therefore form such an oxide layer in the tundish. Due to the process-related inconsistent guidance, however, this can repeatedly break, such that oxides or other impurities deposited on the oxide layer are mixed under the metal melt by turbulence. However, this leads to non-metallic inclusions in the produced metal strip in the form of oxide agglomerates with further integrated alloy elements such as Mg, Si or Cr. These inclusions significantly degrade the quality of the strip and lead, for example, to a deterioration in forming ability. To avoid this, it is known that the metal melt is shielded under the expensive use of inert gas and thus protected against oxidation.

BRIEF SUMMARY OF THE INVENTION

The object of the present invention is therefore to provide a strip casting system which, on the one hand, enables improved control of the volume flow of the aluminium or aluminium alloy melt to the casting gap, improved productivity and improved strip quality and at the same time allows an increase in safety. In addition, a corresponding method should be proposed.

According to a first teaching, this object is achieved in a strip casting system according to the invention in that the strip casting system has at least one active means for transporting metal melt from the casting furnace to the casting gap.

An active means for transporting metal melt from the casting furnace to the casting gap, in contrast to passive means, e.g. passive means exclusively using gravity, is understood to be a means configured to use energy to transport the metal melt so that the transport of the metal melt can be controlled via the active means. The active means for transporting metal melt can, for example, transfer energy mechanically, electrically or electromagnetically to the metal melt. For example, a pump can be used to convert the drive work of the pump into kinetic energy of the metal melt or to transfer energy to the metal melt by applying pressure and convert it into kinetic energy of the metal melt. Active means for transporting metal melt are, for example, suitable for moving the metal melt at least partially against the direction of gravity.

If metal melt is mentioned above or below, this refers to an aluminium or aluminium alloy melt.

It was recognised that by using active means to transport metal melt, the volume flow of the metal melt to the casting gap can be controlled very precisely and directly. In conventional feeding systems which passively feed metal melt to the casting gap by means of gravity, only indirect regulation is possible. The response times are therefore too long for passive means, such as a tundish with delivery, in order to enable real regulation in a fast-running process. In particular, the conventional intermediate storage of the metal melt in a tundish ensures that, for example, changes in the level of the melt pool before the casting gap can only be responded to with a certain time offset. If, on the other hand, the metal melt is actively transported according to the invention, for example by overpressure against gravity, the volume flow of the metal melt can be regulated very precisely. As a result, the metal melt can be fed into a controlled continuous solidification process. The metal melt can in particular be guided very calmly and in a controlled manner, in particular the breaking of an oxide layer in the feeding process and thus the entry of impurities into the melt can be avoided. The costly use of inert gas to avoid the formation of an oxide layer can therefore be dispensed with. Although a tundish can be provided, a tundish, which is generally provided for calming the metal melt in the conventional melt feeding, can preferably be dispensed with. In addition, the productivity of the strip casting system according to the invention can be increased compared to a conventional strip casting system, since the strip speed, due to safety reasons, is generally adjusted as slowly as permitted by the hottest point in the strip.

The strip casting system according to the invention thus allows the production of a high-quality metal strip, in particular an aluminium alloy strip, close to the final dimensions. The active means for transporting the metal melt can also improve safety when operating the strip casting system.

The revolving chill mould of the strip casting system according to the invention can, for example, be a revolving chill mould of one of the conventional methods described at the outset. In particular, the revolving chill mould can thus be a roll pair, roller pair, caterpillar pair or chain pair. For example, a roll pair of a vertical twin roll caster arranged next to one another in parallel with the axis, a roll pair of a horizontal or tilted twin roll caster arranged above one another in parallel with the axis, two casting chains (e.g. Hazelett) or caterpillar chill moulds circulating above one another, which are held by a machine frame or are arranged in a housing. As described above, the revolving chill mould has a casting gap. The casting gap can, for example, be up to 2.5 m wide, so that particularly wide metal strips with a width of over 1.6 m can also be produced, the possible strip width can therefore be close to a roller width, i.e. also approx. 2.5 m. The casting gap can, for example, be 1 to 6 mm high, so that metal strips with a corresponding thickness can be produced. Furthermore, it is advantageous for the metal melt to be cooled in contact with the revolving chill mould at a cooling rate of in particular at least 20 K/s, preferably 50 K/s. By using active means to transport metal melt and in particular the thus possible precise regulation of the feeding of metal melt, significantly higher cooling rates, particularly preferably a cooling rate of at least 100 K/s and/or up to 8000 K/s, can also be set. Due to the high solidification speed, segregation processes that have a negative effect on the material properties can be further reduced. The strip speeds at which the cast metal strip exits the casting gap can be adjusted in the range of 0.06 to 3.0 m/s.

The metal strip can then, for example, be wound in a coil and fed to a subsequent cold rolling step on a cold rolling stand or can also be directly hot and/or cold rolled in-line without intermediate winding. Furthermore, the metal strip can be stored hot between the strip casting and the cold rolling.

The casting furnace can be configured as a container for the temporary storage of metal melt or the casting furnace can be configured as a melting furnace for melting a metal melt. In particular, the casting furnace can be heated and/or regulated.

In a further configuration of the strip casting system, the at least one active means for transporting metal melt comprises a means for pressurising and/or a means for pumping the metal melt.

A means for pressurising is understood to be a means that is designed to pressurise the metal melt in order to transport the metal melt from the casting furnace to the casting gap. For example, the surface of a melt pool in a storage tank for metal melt, for example in the form of a pressure chamber, can be pressurised. A means of pressurising can therefore comprise, for example, a pressure chamber. A pressure chamber is in particular a pre-heated or heatable closed, i.e. pressure-tight, chamber in which metal melt can be provided and pressurised. In particular, the pressure chamber can be provided by a low-pressure furnace in which the metal melt can be heated and pressed into a riser pipe by means of pressurisation, for example. This configuration enables particularly calm and gentle melt guidance as well as simple regulation of the volume flow of the metal melt, for example via the set overpressure on the surface of the melt pool.

Alternatively or additionally, a means can be provided for pumping the metal melt. For this purpose, a means for pumping the metal melt can, for example, comprise a metal pump. A metal pump can, for example, mechanically transport the metal melt, for example by means of a screw. An electromagnetic metal pump is preferably used to transport the metal melt as calmly and evenly as possible.

In the event of a failure of the strip casting machine, for example due to a power failure, no further metal melt is conveyed and continued running can also be avoided.

According to a further configuration of the strip casting system, the at least one active means for transporting metal melt comprises a pressure furnace, in particular a low-pressure furnace.

A pressure furnace is in particular a closed furnace which provides a heatable chamber which can be pressurised. If low pressure is applied to the chamber, it is a low-pressure furnace. The use of low pressure enables safe and calm guidance and regulation of the metal melt. For example, a low-pressure furnace is configured to enable pressurisation at 0.1 to 1.0 bar. Preferably a pressurisation of 0.3 to 0.6 bar for the smoothest possible transport of the metal melt or 0.5 to 1.0 bar for a faster feeding of the metal melt to the casting gap.

Advantageously, for example, commercially available low-pressure furnaces used for low-pressure chill casting or correspondingly scaled versions thereof can be used.

If the pressure or low-pressure furnace also has a riser pipe, a particularly safe strip casting system is provided because the metal melt can sink back into the pressure chamber automatically through the riser pipe in particular in the event of failure of the pressurisation.

The casting furnace can be designed separately from the active means for transporting metal melt. However, a particularly simple and economical strip casting system results if, according to a next configuration of the strip casting system, the casting furnace is configured as a low-pressure furnace. Further active means for transporting the metal melt can then be dispensed with, for example. The simpler embodiment also enables simplified and thus improved regulation of the volume flow and increased safety of the strip casting system.

In a next configuration of the strip casting system, the strip casting system is a vertical strip casting system. It has been found that the feeding of metal melt to the casting gap provided according to the invention can be used particularly advantageously for vertically aligned strip casting systems in which a casting region or casting gusset is arranged above the casting gap. In the case of vertical strip casting systems in particular, the conventional feeding of metal melt from above to the casting gap leads to the unregulated formation of oxides in the upstream tundish, which can unregulatedly enter the casting gap via the outflow from the tundish. Even if the tundish outflow was conceivably designed as a immersion pipe with one end below the bath level of the melt pool, turbulence could still occur such that the oxides are not discharged from the tundish in a controlled manner. This poses a problem, in particular for aluminium melts, which can however be avoided with a vertical strip casting system with the guidance of the metal melt proposed above.

In a further configuration of the strip casting system, the strip casting system has means for regulating the volume flow of the metal melt to the casting gap and/or the height of the melt level in the casting gap.

It has been recognised that the feeding of the metal melt via active means for transporting the metal melt can be advantageously used to enable precise and fast regulation of the volume flow of the metal melt to the casting gap. If, for example, the metal melt is moved against gravity by applying pressure, the volume flow can be controlled very precisely. The volume flow of the metal melt can then be set and regulated very precisely by means of a pressure measurement and corresponding pressure regulation. For example, a control loop can have a computer configured to regulate the pressure for optimal operation, for example according to a known or determined correlation of pressure and required volume flow for a desired strip casting speed. For example, pressure sensors can be provided to measure the pressure in a pressure chamber or a low-pressure furnace. It is also possible to regulate the volume flow by measuring the fill level of the metal melt in the casting region or casting gusset, for example. For example, the fill level of the metal melt in the casting region or casting gusset and the pressure in a pressure chamber can be measured. Such a combined measurement allows a faster control loop to be set up. For example, the casting region or casting gusset can have at least one fill level sensor and a low-pressure furnace can have at least one pressure sensor for this purpose. In particular, existing pressure sensors can also be used in low-pressure furnaces, for example. The fill level or level of metal melt can, for example, be detected with non-contact eddy current distance sensors, inductive probes, optical processes, contact probes or immersion sensors. The level is preferably determined by means of laser measurement, for example the casting region can have at least one laser distance sensor.

In contrast to conventional feeding systems, in which only indirect regulation is conceivable due to the feeding of the casting gap via a tundish or very slow regulation is conceivable due to the long response times, active and fast regulation of the volume flow can thus be implemented. Since vertical strip casting processes in particular run very quickly, fast regulation is very important for these processes in particular.

According to the next configuration of the strip casting system, the strip casting system has a casting region arranged in front of the casting gap.

The casting region is arranged in front of the revolving chill mould and is generally delimited by the revolving chill mould. The casting region is, for example, a casting gusset and/or a distributor nozzle. The casting region can be designed as a casting gusset, with the casting region or the casting gusset being formed by the revolving chill mould and at least one side dam, preferably two side dams, which are attached opposite to both sides of the revolving chill mould. In the casting region, during the manufacture of a metal strip, a melt pool is formed from which metal melt flows or is drawn into the roll gap. In the case of vertical strip casting systems, the casting region or casting gusset is arranged substantially above the casting gap and delimited by the upper region of the revolving chill mould. In the case of horizontal or tilted strip casting systems, the casting region is arranged laterally from and in particular slightly elevated in relation to the casting gap.

The casting region or casting gusset enables a particularly uniform distribution of the metal melt over the entire width of the revolving chill mould and the continuous feeding of the metal melt to the casting gap via the melt pool formed in the casting region.

In particular in the case of horizontal or tilted strip casting systems, a distributor nozzle can also be provided via which the metal melt can be fed into the casting gap and distributed over the entire width of the casting gap. For example, the distributor nozzle is closed just before the casting gap, so that the metal melt is only exposed to the air for a short time or not at all. In this case, the casting region is, for example, substantially formed by the revolving chill mould and the ends of the distribution nozzle or only by the distributor nozzle, so that additional side dams can be completely or partially dispensed with.

In a further configuration of the strip casting system, the casting furnace is connected to the casting region by a pipe system. In particular, the casting furnace is connected to the casting gusset and/or the distributor nozzle by a pipe system.

In contrast to the conventionally used open channel system, the closed connection between the casting furnace and casting region in the form of a pipe system can ensure that there is no unregulated oxidation of the surface of the metal melt when the metal melt is guided to the casting region. The pipe system also enables particularly calm and regulatable guidance of the metal melt from the casting furnace to the casting region. If the pipe system is also substantially an air and/or gas-tight pipe system, unregulated oxidation of the metal melt can be even better avoided. In addition, through the use of closed pipes, metal melt can also be guided advantageously in terms of safety at least in part against gravity. Preferably, the strip casting system or the pipe system comprises at least one heatable pipe and/or at least one ceramic pipe, particularly preferably at least one heatable ceramic pipe. Premature solidification of the metal melt can thus be avoided. The pipe system even more preferably only has heatable pipes, in particular heatable ceramic pipes.

According to the next configuration of the strip casting system, the strip casting system comprises means for feeding the metal melt to the casting region, via which the metal melt can be supplied to the casting region below the surface of a melt pool formed in the casting region.

If the means for feeding the metal melt into the casting region are configured such that the metal melt can be fed to the casting region below the surface of a melt pool, the surface of the melt pool can be kept even calmer. This prevents the surface of the melt pool from breaking. On the one hand, this can prevent the unregulated formation of oxides. On the other hand, the unregulated mixing of oxides can also be effectively avoided because turbulence of the surface or movement of the surface can be avoided. This can prevent a formed oxide layer being absorbed and mixed in an uncontrolled manner.

In a further configuration of the strip casting system, the casting region has at least one side dam, wherein the at least one side dam has at least one feed opening for metal melt. In particular, the casting region is a casting gusset here.

It has been shown that when the metal melt is fed to the melt pool via the side plate, disturbances and turbulences of the surface of the melt pool can be reduced or avoided. If the at least one feed opening is advantageously also arranged in such manner that it lies below the surface of the melt pool formed in the casting gusset during the ongoing operation of the strip casting system, a penetration of the surface of the melt pool, disturbances of the surface of the melt pool or turbulences can be particularly successfully avoided. This form of feeding has proven to be particularly advantageous in the case of vertical strip casting systems in particular.

In a further configuration of the strip casting system, the casting region has at least two, preferably three, feed openings for a metal melt. In particular, a more even distribution of the metal melt in the casting region can thus be achieved. In particular, the formation of a pronounced temperature gradient parallel to the casting gap can be avoided in a melt pool such that a particularly uniform solidification of the metal melt in the casting gap can be achieved. In the case of horizontal or tilted strip casting systems, the at least two, preferably three, feed openings can preferably be arranged in the base of the casting region such that the metal melt can be fed to the casting region substantially against the direction of gravity from below. The at least two feed openings are further preferably arranged in the width direction substantially at opposite ends of the casting region. A third feed opening is, for example, arranged centrally between two other feed openings.

This enables a particularly uniform feeding of the casting gap with metal melt and the provision of homogeneous isothermal metal melt at a constant speed at the casting gap.

The casting region can also be charged with inert gas to avoid oxide formation on the surface of the melt pool.

According to a second teaching, the object stated above is achieved in a method according to the invention for feeding a metal melt to the casting gap in a strip casting system in that the metal melt is actively transported into the casting gap. If the metal melt is actively transported according to the invention, for example by overpressure against gravity, the volume flow of the metal melt can be regulated very precisely. As a result, the metal melt can be fed into a controlled continuous solidification process. The metal melt can in particular be guided very calmly and in a controlled manner, in particular the breaking of an oxide layer in the feeding process and thus the entry of impurities into the melt can be avoided. The metal melt can, for example, be fed into the melt pool in such manner that the surface of the melt pool is not penetrated or disturbed by bath movements.

In particular, the method can be carried out with a strip casting system according to the invention.

In a further configuration of the method, the at least one casting furnace is pressurised to transport the metal melt. For example, the surface of a melt pool in the casting furnace can be pressurised. Preferably, the casting furnace is a low-pressure furnace in which the metal melt is heated and pressed into a riser pipe, for example, by applying pressure. This configuration enables particularly calm and gentle melt guidance as well as simple regulation of the volume flow of the metal melt, for example via the set overpressure.

In the next configuration of the method, the metal melt is transported at least in sections against the direction of gravity. Guidance of the metal melt at least in sections against the direction of gravity enables a particularly controllable and regulatable volume flow of the metal melt. In addition, in the event of a system failure, the metal melt can fall back into a riser pipe and/or a casting furnace in the direction of gravity, for example, so that the metal melt does not continue to run and work safety can be increased.

If, according to a further configuration of the method, a melt pool is or will be formed before the casting gap and if the metal melt is guided from the casting furnace to the melt pool substantially under air and/or gas exclusion, an unregulated oxidation of the metal melt can be even better avoided. For example, the strip casting system has a casting gusset and/or a distributor nozzle arranged in front of the casting gap and the casting furnace is connected to the casting gusset and/or the distributor nozzle by a pipe system, wherein the pipe system is or will be substantially completely filled with metal melt. 'Substantially completely' refers here to the fact that unavoidable impurities may be present.

According to a further configuration of the method, the metal melt is fed into the melt pool below the surface of the melt pool. For example, a melt pool is or will be formed before the casting gap and the metal melt is fed to this melt pool below the surface of the melt pool. This prevents the surface of the melt pool from being penetrated and/or swirled, which can lead to the unregulated mixing of oxides into the metal melt.

The metal melt can also advantageously be fed to the melt pool laterally and/or from below. Preferably, the metal melt is continuously fed into the melt pool or the casting gap, i.e. in particular without a temporary storage of metal melt in a tundish.

BRIEF DESCRIPTION OF THE DRAWINGS

Further configurations and advantages of the invention can be drawn from the following detailed description of a number of exemplary embodiments of the present invention, in particular in combination with the drawings, in which.

DETAILED DESCRIPTION OF THE INVENTION

Figure 1:
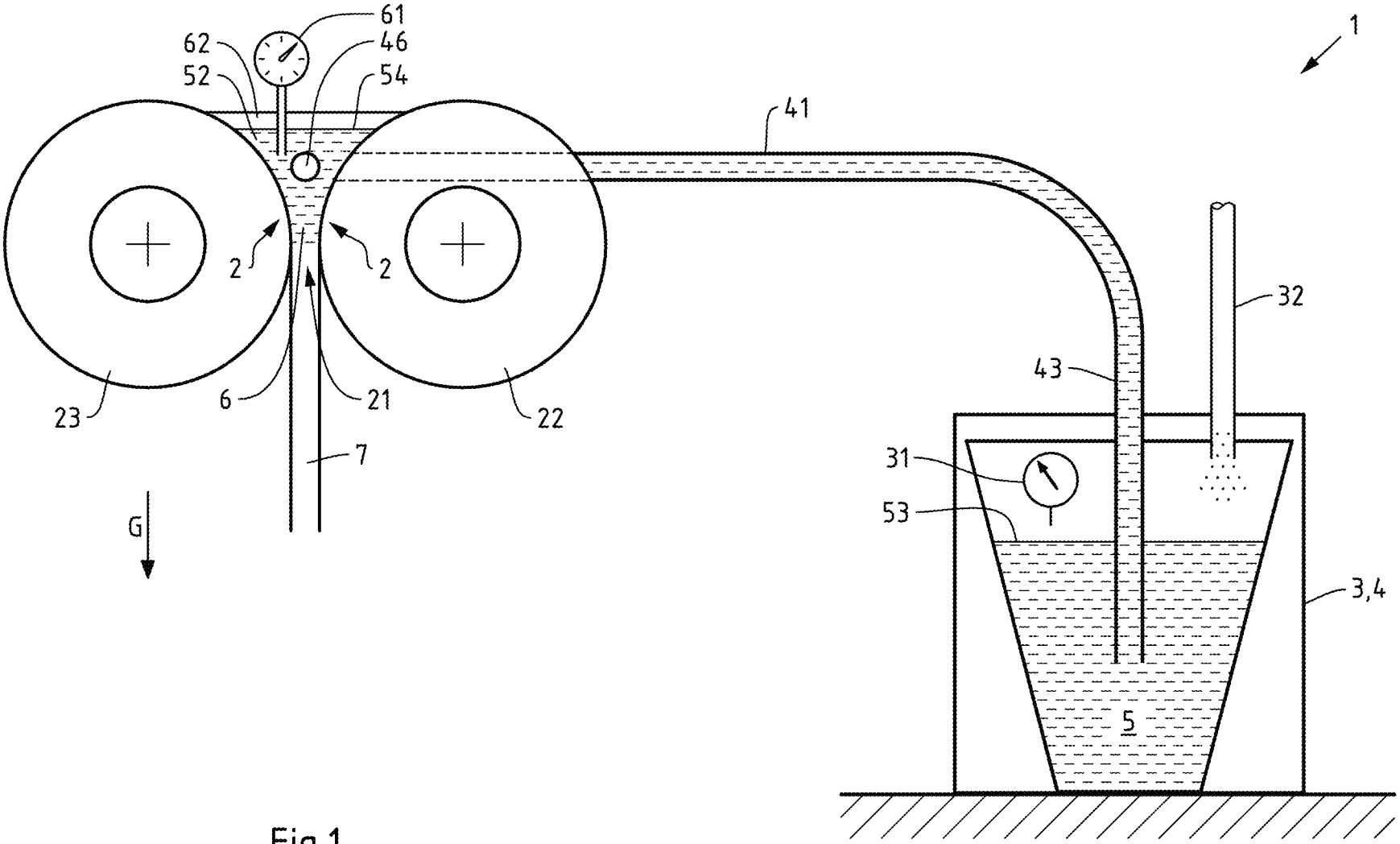
FIG. 1 shows a schematic sectional view of an exemplary embodiment of a vertical strip casting system according to the invention.

FIG. 1 shows a strip casting system 1 comprising a revolving chill mould 2 with a casting gap 21, with the revolving chill mould 2 being formed by two rolls 22, 23, and a casting furnace 3, with the strip casting system 1 having an active means 4 for transporting metal melt 5 from the casting furnace 3 to the casting gap 21. The strip casting system 1 here is a vertical strip casting system 1. In this example, the active means 4 for transporting metal melt 5 comprises a means 4 for pressurising the metal melt 5 so that the same can be actively transported by the active means 4 from the casting furnace 3 to the casting gap 21. In this example, the casting furnace 3 is configured as an active means 4, in particular as a low-pressure furnace 4. The exemplary strip casting system 1 has a casting region 6 arranged in front of the casting gap 21, which is configured as a casting gusset 6 and is arranged above the casting gap 21. The casting furnace 3, 4 is connected to the casting gusset 6 by a pipe system 42, 43, which comprises heatable ceramic pipes 42, 43. Furthermore, the casting gusset 6 has two side dams 62, with a side dam 62 having a feed opening 46 for the metal melt 5. The feed opening 46 is provided here as a means 46 for feeding the metal melt 5 into the casting gusset 6, via which the metal melt 5 can be fed to the casting region 6 below the surface of the melt pool 52 formed in the casting region. The exemplary strip casting system 1 thus comprises means 46 for feeding the metal melt 5 to the casting region 6, which can feed the metal melt 5 to the casting region 6 below the surface of a melt pool 52 formed in the casting region 6. In this case, the metal melt 5 is, for example, an aluminium melt 5.

If the surface of the melt pool 53 is pressurised in the low-pressure furnace 3, 4, for example via an air or gas supply 32, for example with 0.1 to 1.0 bar, preferably 0.5 and 0.6 bar, the metal melt 5 can be transported via the riser pipe 43 and the heated pipe 41 to the casting region 6 against the direction of gravity G. This enables particularly calm and gentle melt guidance to the melt pool 52 without the surface of the melt pool 52 being penetrated or disturbed by movements of the surface or turbulence of the metal melt. Since the metal melt 5 is transported against gravity, the exemplary strip casting system 1 is configured very safely, since the metal melt 5 falls back into the low-pressure furnace 3, 4 in the event of a system failure, in particular through the riser pipe 43. In addition, an easy regulation of the volume flow of the metal melt to the casting gap is enabled. For this purpose, the exemplary strip casting system 1 has means for regulating the volume flow of the metal melt 5 in the casting gap 21 and/or the height of the melt level in the casting gap 21 in the form of a control loop. For this purpose, the control loop draws on measured values from a fill level sensor 61, which measures the fill level or level of the melt pool 52 in the casting region 6, and also on a pressure sensor 31, which measures the pressure in the low-pressure furnace 3, 4. If, for example, a lowering of the fill level of the melt pool 52 is detected by means of the fill level sensor 61, the pressure in the low-pressure furnace 3, 4 can, for example, be increased in a controlled manner in order to bring the fill level back to an optimal fill level. In contrast to the gravity-based conventional feeding system, the exemplary strip casting system 1 can thus be actively and precisely regulated with fast response times.

Figure 2:
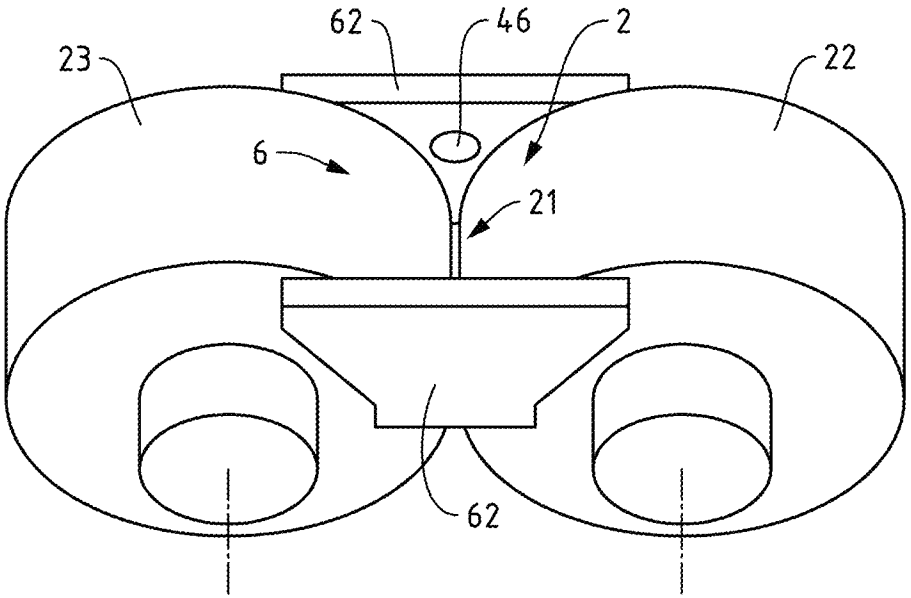
FIG. 2 shows a perspective representation of the casting region of the exemplary embodiment from FIG. 1.

FIG. 2 shows, in a perspective view, the casting region 6 of the exemplary vertical strip casting system 1 from FIG. 1. The revolving chill mould 2 of the exemplary strip casting system 1 is thereby formed by two rolls 22, 23. The casting region 6 is designed here as a casting gusset 6 and is formed by the rolls 22, 23 of the revolving chill mould 2 and two side dams 62. In this case, a side dam 62 has a feed opening 46 via which a metal melt 5 can be fed to the casting region 6 below the surface of a melt pool 52 formed in the casting region. Compared to conventional methods, which work with an immersion pipe from a tundish located above the melt, the tundish can be dispensed with, in which oxide formation and the described negative effects, such as uncontrolled oxide entry into the melt, occur.

Figure 3:
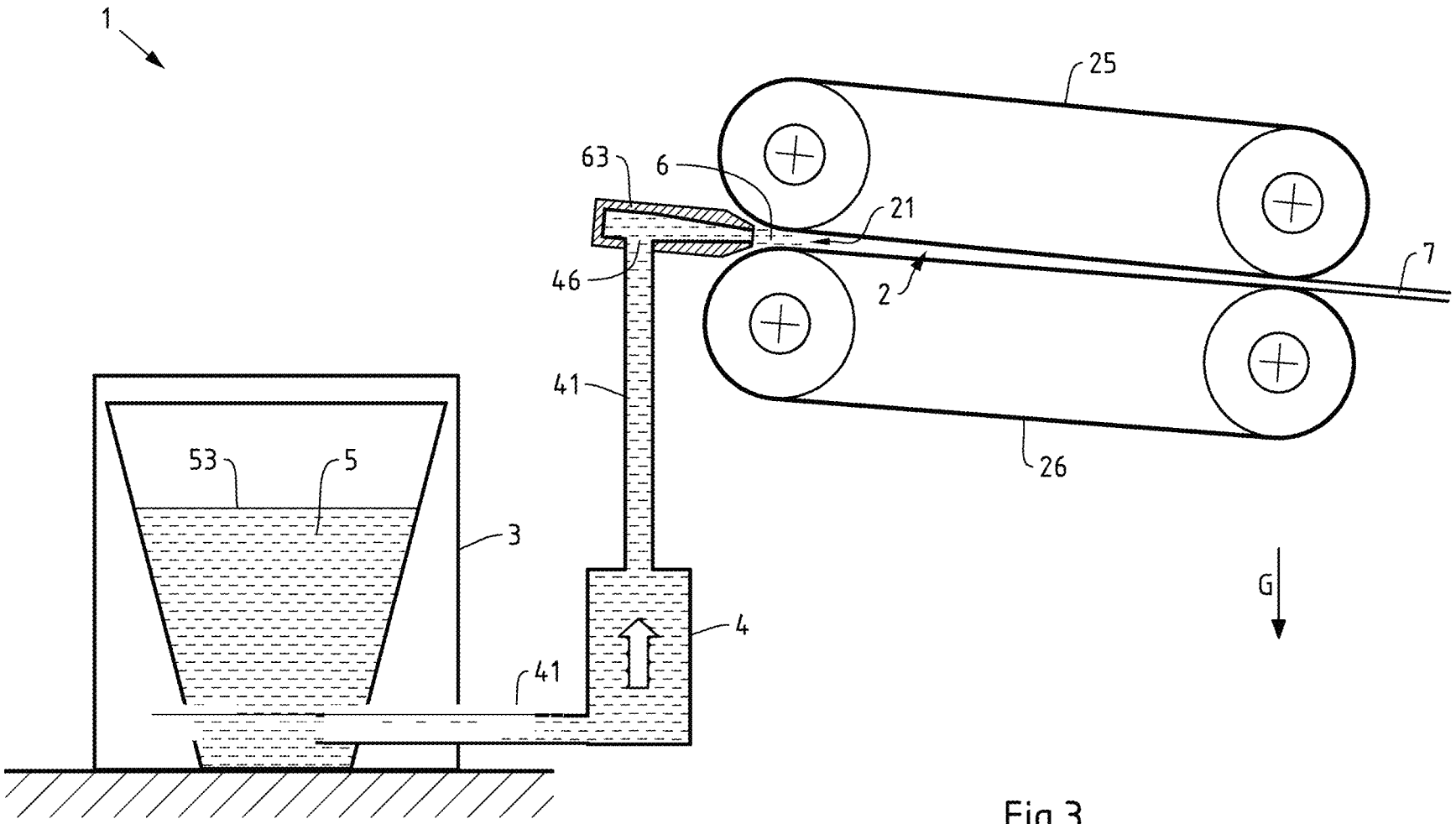
FIG. 3 shows a schematic sectional view of a further exemplary embodiment of a horizontal strip casting system not according to the invention.

FIG. 3 shows a strip casting system 1 not according to the invention comprising a revolving chill mould 2 with a casting gap 21, with the revolving chill mould 2 being formed by two (dam block) chains 25, 26 and a casting furnace 3, with the strip casting system 1 having an active means 4 for transporting metal melt 5 from the casting furnace 3 to the casting gap 21. Here, the strip casting system 1 is a horizontal or tilted strip casting system 1. In this example, the active means 4 for transporting metal melt 5 comprises a means 4 for pumping the metal melt 5 in the form of an electromagnetic metal pump 4, so that the metal melt 5 can be transported from the casting furnace 3 from below into the distributor nozzle 63. The casting region 6 is, for example, formed by the closed distributor nozzle 63.

Figure 4:
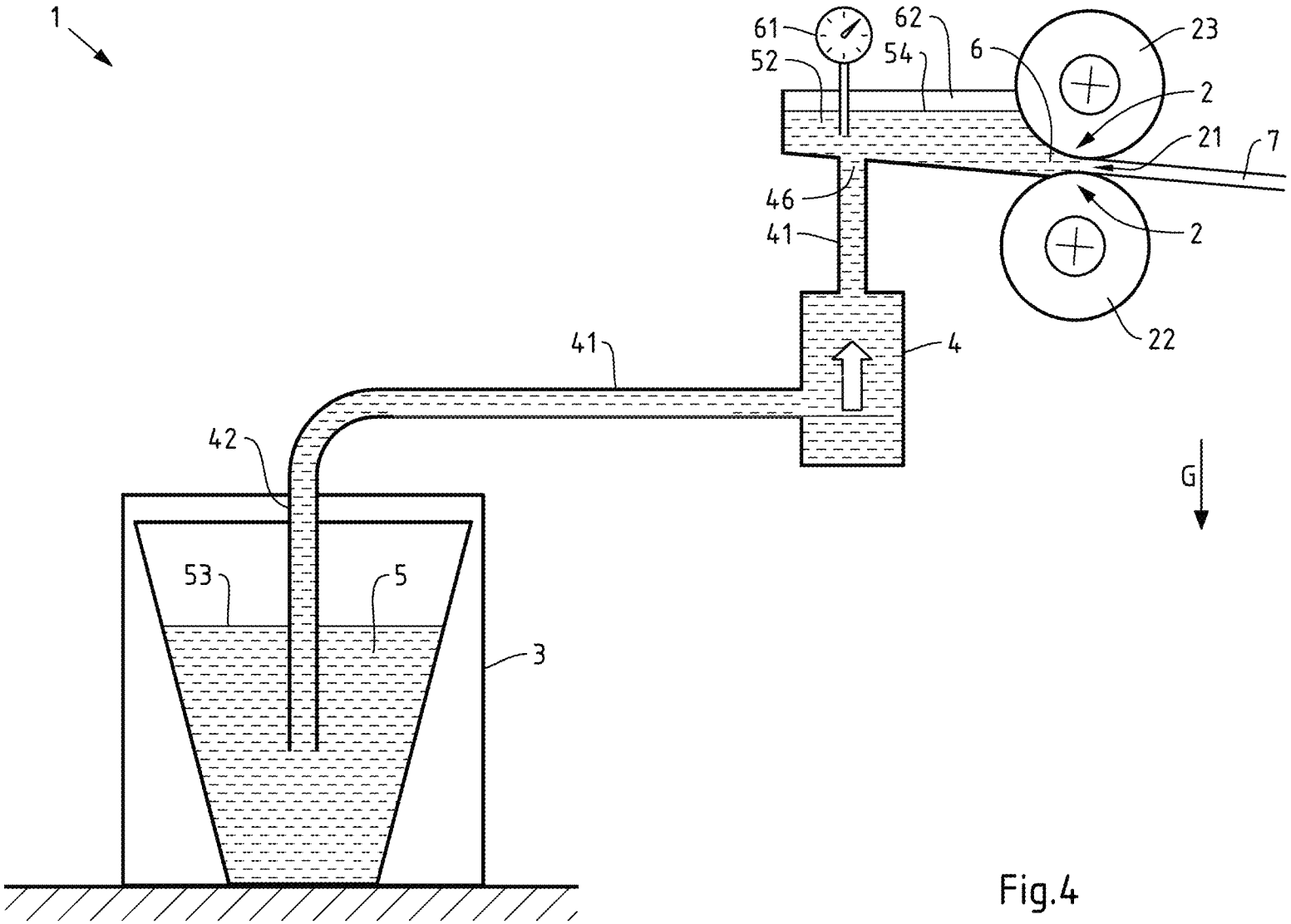
FIG. 4 shows a schematic sectional view of a further exemplary embodiment of a horizontal strip casting system according to the invention and FIG. 5 shows a schematic representation of a further exemplary embodiment of a horizontal strip casting system according to the invention.

FIG. 4 shows a further strip casting system 1 according to the invention comprising a casting furnace 3 and a revolving chill mould 2 with a casting gap 21, with the revolving chill mould 2 being formed by two rolls 22, 23, with the strip casting system 1 having an active means 4 for transporting metal melt 5 from the casting furnace 3 to the casting gap 21. Here, the strip casting system 1 is a horizontal or tilted strip casting system 1. The metal melt 5 is actively transported via the metal pump 4 from below through the feed opening 46 into the casting region 6. A melt pool 52 is formed here in the casting region 6.

Figure 5:
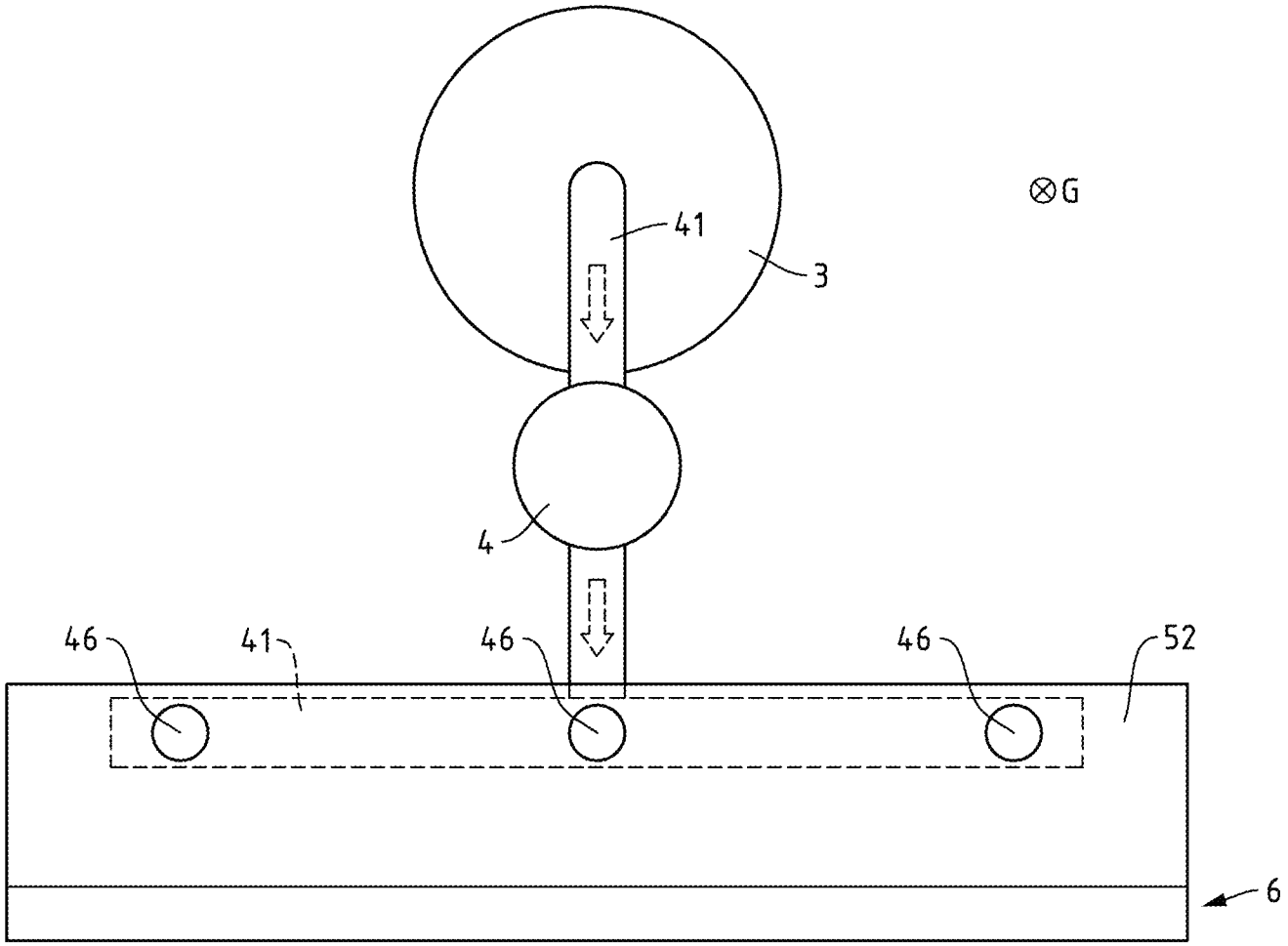

FIG. 5 shows an exemplary strip casting system, with the casting region 6 having at least three feed openings 46 for metal melt. Two feed openings 46 are arranged in the width direction substantially at opposite ends of the casting region 6. A third feed opening 46 is arranged centrally between the two other feed openings 46. The metal melt 5 is actively transported from the casting furnace 3 via the metal pump 4 from below through the feed opening 46 into the casting region 6. As shown in FIG. 6, the feeding from the furnace can be branched via the pipe 41 into a plurality of strands and fed through a plurality of pipes perpendicular thereto via a plurality of feed openings 46 to the casting region 6, in particular a casting gusset and/or a distributor nozzle against the direction of gravity G. Thus, for example, melt can be fed into the distribution system at a plurality of points simultaneously at the same temperature and speed and thus it can be achieved that a homogeneous isothermal melt flows over the entire width in the outlet into the casting gap 21.

The described exemplary embodiments of the strip casting system 1 each enable the uniform feeding of aluminium melt 5 into casting regions 6 or to casting gaps 21, so that the cast rolling processes can be stabilised, productivity improved and material defects avoided. This can, for example, be achieved by the metal melt 5 being fed under the surface of a melt pool 52 to the casting roll gap 21 such that the surface of the existing melt pool 52 is not penetrated or disturbed by bath movement. This avoids oxygen contact of the inflowing metal melt 5 and thus reduces the total amount of oxides formed. Furthermore, for example, there is an intact, calm oxide layer 54 on the surface of the melt pool 52, which is not mixed into the melt and which protects the melt pool 52 from further oxidation. This prevents non-metallic inclusions in the strip produced.

This means that the strip casting system 1 can be operated at the optimum speed without the risk of local melt penetrations. The strip quality can be kept consistent over the entire width. Uneven solidification over the width of the casting gap and thus, for example, local penetrations of melt through the casting gap can thus be avoided. This can also prevent surface flaws, cracks in the strip or casting breaks.

Furthermore, a melt introduced from below or laterally can be distributed in individual strands over the casting width, i.e. the width of the casting gap, so that a homogeneous inflow to the casting gap can be achieved at a uniform temperature and/or uniform speed. This can improve the uniformity of product properties over the strip width and further increase the productivity of the system by reducing the risk of local melt penetrations.

The described exemplary embodiments may also be advantageous for reasons of occupational safety. If problems occur in the molten area of the system, the transport system can be switched off and the residual melt in the system falls immediately back into the furnace with gravity G through the riser pipe 42. There is no further flow of the melt into the casting region.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A strip casting system for aluminium and/or aluminium alloys comprising at least one casting furnace and at least one revolving chill mould having a casting gap, wherein the at least one revolving chill mould is designed as a roll pair, roller pair, caterpillar pair or belt pair, wherein the strip casting system has at least one active means for transporting aluminium or aluminium alloy melt from the casting furnace to the casting gap, wherein the strip casting system has a casting region arranged in front of the casting gap, wherein the casting region is delimited on at least one side by the revolving chill mould and the casting region is designed in such manner that an aluminium or aluminium alloy melt pool is formed in the casting region, from which aluminium or aluminium alloy melt flows or is drawn into the casting gap, wherein the casting furnace is connected to the casting region by a pipe system, wherein the strip casting system comprises means for feeding the aluminium or aluminium alloy melt into the casting region, which can feed the aluminium or aluminium alloy melt to the casting region below a surface of the aluminium or aluminium alloy melt pool formed in the casting region, wherein the casting region has at least one side dam, wherein the at least one side dam has at least one feed opening for aluminium or aluminium alloy melt.

2. The strip casting system according to claim 1, wherein the at least one active means for transporting aluminium or aluminium alloy melt comprises a means for pressurising and/or a means for pumping the aluminium or aluminium alloy melt.

3. The strip casting system according to claim 1, wherein the at least one active means for transporting aluminium or aluminium alloy melt comprises a pressure furnace.

4. The strip casting system according to claim 1, wherein the casting furnace is configured as a low-pressure furnace configured to enable pressurisation at 0.1 to 1.0 bar.

5. The strip casting system according to claim 1, wherein the strip casting system is a vertical strip casting system.

6. The strip casting system according to claim 1, wherein the strip casting system has means for regulating the volume flow of the aluminium or aluminium alloy melt to the casting gap and/or the height of the melt level in the casting gap.

7. A strip casting system for aluminium and/or aluminium alloys comprising at least one casting furnace and at least one revolving chill mould having a casting gap, wherein the at least one revolving chill mould is designed as a roll pair, roller pair, caterpillar pair or belt pair, wherein the strip casting system has at least one active means for transporting aluminium or aluminium alloy melt from the casting furnace to the casting gap, wherein the strip casting system has a casting region arranged in front of the casting gap, wherein the casting region is delimited on at least one side by the revolving chill mould and the casting region is designed in such manner that an aluminium or aluminium alloy melt pool is formed in the casting region, from which aluminium or aluminium alloy melt flows or is drawn into the casting gap, wherein the casting furnace is connected to the casting region by a pipe system, wherein the strip casting system comprises means for feeding the aluminium or aluminium alloy melt into the casting region, which can feed the aluminium or aluminium alloy melt to the casting region below a surface of the aluminium or aluminium alloy melt pool formed in the casting region, wherein the casting region has at least two feed openings for aluminium or aluminium alloy melt.

8. A method for feeding an aluminium or aluminium alloy melt to the casting gap in a strip casting system for aluminium and/or aluminium alloys comprising at least one casting furnace and at least one revolving chill mould designed as a roll pair, roller pair, caterpillar pair or belt pair with a casting gap, wherein the aluminium or aluminium alloy melt is actively transported into a casting region arranged in front of the casting gap, wherein the casting region is delimited on at least one side by the revolving chill mould and the casting region is designed in such manner that an aluminium or aluminium alloy melt pool is formed in the casting region, from which aluminium or aluminium alloy melt flows or is drawn into the casting gap, wherein the aluminium or aluminium alloy melt is actively fed to the casting region below a surface of the aluminium or aluminium alloy melt pool formed in the casting region.

9. The method according to claim 8, wherein the at least one casting furnace is pressurised to transport the aluminium or aluminium alloy melt.

10. The method according to claim 8, wherein the aluminium or aluminium alloy melt is transported at least in sections against the direction of gravity (G).

11. The strip casting system according to claim 3, wherein the pressure furnace is a low-pressure furnace configured to enable pressurisation at 0.1 to 1.0 bar.

12. The strip casting system according to claim 7, wherein the casting region has three feed openings for aluminium or aluminium alloy melt.

13. The method according to claim 8, wherein the method is carried out with a strip casting system according to claim 1.

* * * * *